US008360807B2

(12) United States Patent
Buff et al.

(10) Patent No.: US 8,360,807 B2
(45) Date of Patent: Jan. 29, 2013

(54) MULTIPLE COAXIAL CABLE PLUG CONNECTION AND METHOD FOR INSTALLING SUCH A MULTIPLE COAXIAL CABLE PLUG CONNECTION

(75) Inventors: Roman Buff, St. Gallen (CH); Mario Schneider, Oberriet (CH)

(73) Assignee: Huber + Suhner AG, Herisau (CH)

( * ) Notice: Subject to any disclaimer, the term of this patent is extended or adjusted under 35 U.S.C. 154(b) by 232 days.

(21) Appl. No.: 12/735,791

(22) PCT Filed: Jan. 22, 2009

(86) PCT No.: PCT/CH2009/000029

§ 371 (c)(1),
(2), (4) Date: Aug. 18, 2010

(87) PCT Pub. No.: WO2009/111895

PCT Pub. Date: Sep. 17, 2009

(65) Prior Publication Data

US 2010/0330838 A1 Dec. 30, 2010

(30) Foreign Application Priority Data

Mar. 14, 2008 (CH) ..... 382/08

(51) Int. Cl.
*H01R 9/05* (2006.01)

(52) U.S. Cl. ..... 439/581; 439/752

(58) Field of Classification Search ..... 439/578, 439/581, 701, 752

See application file for complete search history.

(56) References Cited

U.S. PATENT DOCUMENTS

| | | | | |
|---|---|---|---|---|
| 4,368,940 | A * | 1/1983 | Sugiura | 439/170 |
| 5,194,020 | A * | 3/1993 | Voltz | 439/579 |
| 5,462,445 | A * | 10/1995 | Anhalt | 439/188 |
| 5,928,038 | A | 7/1999 | Berg et al. | |
| 6,409,550 | B1 | 6/2002 | Splichal et al. | |
| 6,457,999 | B1 | 10/2002 | Baker et al. | |
| 6,824,427 | B1 * | 11/2004 | Feldman et al. | 439/581 |
| 7,018,216 | B1 * | 3/2006 | Clark et al. | 439/63 |
| 7,223,131 | B2 * | 5/2007 | Moll et al. | 439/752 |
| 7,544,093 | B2 * | 6/2009 | Soubh et al. | 439/581 |
| 7,682,205 | B2 * | 3/2010 | Hall et al. | 439/752 |
| 7,892,048 | B2 * | 2/2011 | Shi et al. | 439/752 |

FOREIGN PATENT DOCUMENTS

| | | |
|---|---|---|
| EP | 0 582 960 | 2/1994 |
| WO | WO 92/22943 | 12/1992 |
| WO | WO 98/33243 | 7/1998 |

* cited by examiner

*Primary Examiner* — Hien Vu
(74) *Attorney, Agent, or Firm* — Pauley Petersen & Erickson

(57) ABSTRACT

A multiple coaxial cable plug connection (50), particularly for the detachable connection of a plurality of coaxial cables to a circuit board for operating frequencies of several GHz, comprises a first connector (10) and a second connector (20), wherein said connectors (10, 20) can be inserted in each other along a plug axis, wherein the first connector (10) has a plurality of first coaxial contact arrangements (26) disposed next to each other transversely to the plug axis, and the second connector (20) is equipped with second coaxial contact arrangements (27) that match the first coaxial contact arrangements (26), and wherein the first coaxial contact arrangements (26) each are attached to the end of an associated coaxial cable. High precision of the connection, and at the same time a reduced insertion force, are achieved in such a multiple coaxial cable plug connection in that the first coaxial contact arrangements (26) are floatingly supported in a first housing (11), while the second coaxial contact arrangements (27) are permanently installed in a second housing (21).

17 Claims, 7 Drawing Sheets

Fig.11
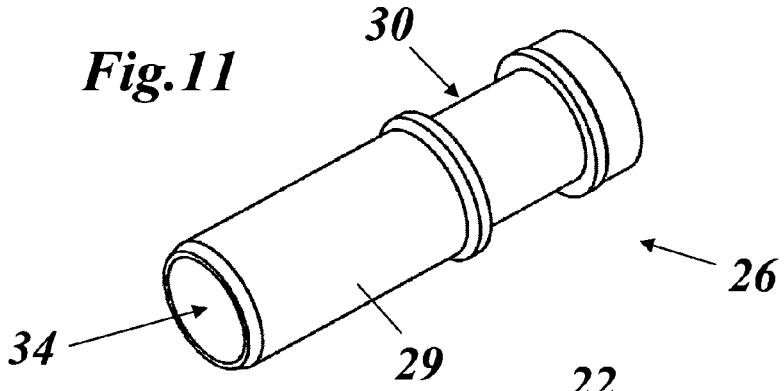
Fig.12
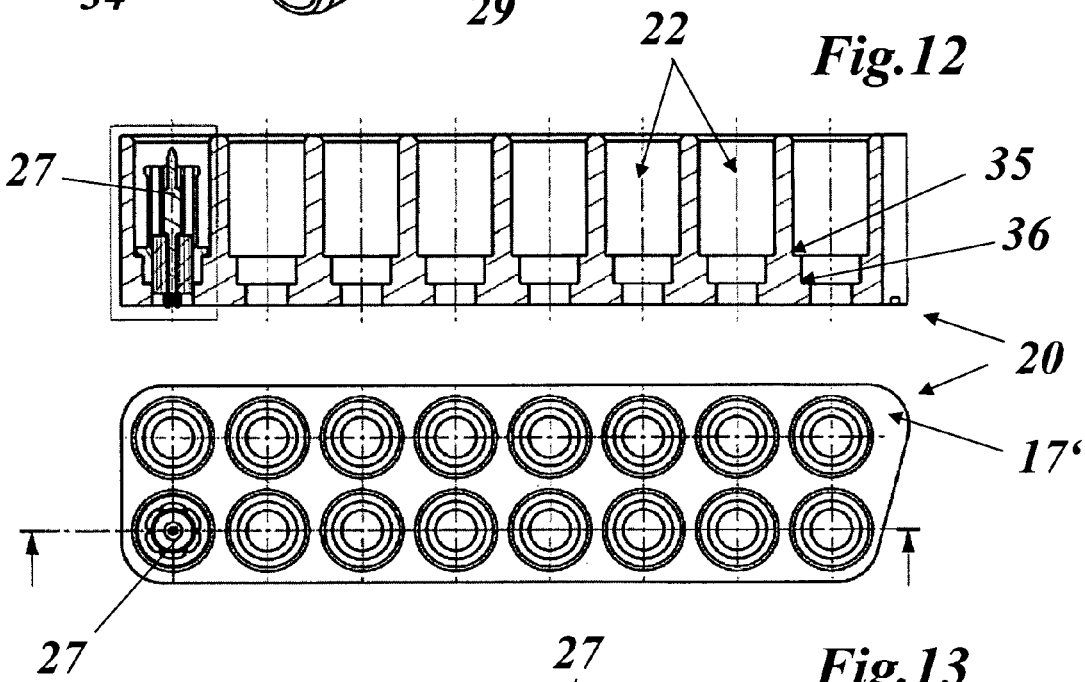
Fig.13
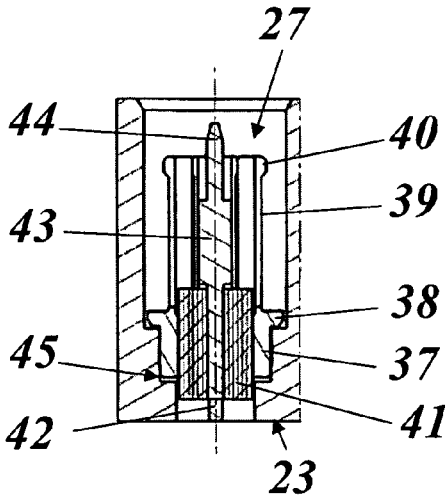
Fig.14

MULTIPLE COAXIAL CABLE PLUG CONNECTION AND METHOD FOR INSTALLING SUCH A MULTIPLE COAXIAL CABLE PLUG CONNECTION

BACKGROUND OF THE INVENTION

1. Field of the Invention

In the past, a wide variety of proposals have been made relating to multiple plug connections in which a plurality of coaxial cables are connected to a circuit board for radio-frequency purposes in one plugging operation at the same time. In the case of multiple coaxial cable plug connections of this type, it is not only necessary to align the contact arrangements of the individual connection points with one another, but it is also necessary to ensure that the RF connection is made up to the highest frequencies with the lowest possible attenuation. Furthermore, care should be taken that, when there are a large number of connection points or coaxial cables to be connected, the plugging forces which have to be expended during the plugging operation can be managed.

2. Discussion of Related Art

WO-A1-92/22943 discloses, for example, a coaxial connector system of high density for use in printed circuits, in which, on the cable side, the cables which are provided with a coaxial contact arrangement are inserted into holes in a grouping plate and latched there. A plurality of grouping plates are held in parallel in one housing, with the coaxial contact arrangements projecting forward out of the housing and being inserted into corresponding holes in a mating piece which is arranged on the circuit board. Electrical contact is established in the mating contact via a central pin for the internal conductor and via a contact tongue, which is arranged laterally in the hole, for the external conductor. In the case of this solution, the design is very simple and the plugging force is comparatively low. On the other hand, this solution is unsuitable for higher and extremely high frequencies in the GHz range owing to the unfavorable contact geometry and lack of precision.

EP-A1-0 582 960 discloses an RF coaxial plug connection in which the coaxial mating plug connector for the coaxial plugs are integrated in a metal monoblock which forms the common external conductor for all the mating plug connectors. The coaxial plugs themselves are combined to form one unit by means of a common mounting plate, arranged on a board and attached by means of press-in contacts with a specific spacing. Flexible alignment of the individual plug connections with one another is not possible here.

WO-A2-98/33243 discloses a comparable RF coaxial plug connector in which, instead of the metal block in the mating plug connector, a plastic housing with a metallized inner wall as the external conductor is inserted. Flexible alignment in the case of individual plug connections is not possible in this case either.

SUMMARY OF THE INVENTION

The object of the invention is therefore to provide a multiple coaxial cable plug connection, which is suitable for use in circuit boards in particular, in which a very high degree of precision in the plugged connections and therefore an achievable operating frequency in the two-digit GHz range, in particular up to 40 GHz, with easily manageable plugging forces and a sufficient number of plugging cycles, is achieved on account of the flexible alignment of the individual plug connections with one another, and also to specify a method for installing said multiple coaxial cable plug connection.

The object is achieved by all the features of claims 1 and 17. The essential features of the invention are two plug connectors, with the first plug connector having a plurality of first coaxial contact arrangements which are arranged next to one another transverse to the plug axis, and the second plug connector being equipped with the second coaxial contact arrangements which match the first coaxial contact arrangements, and with the first coaxial contact arrangements in each case being attached to the end of an associated coaxial cable. The advantageous properties of the plug connection according to the invention are achieved in that the first coaxial contact arrangements are mounted in a floating manner in a first housing, while the second coaxial contact arrangements are fixedly installed in a second housing. In this way, it is possible to align the (highly precise) first and second contact arrangements in pairs, so that plugging contact which is optimum for RF purposes and a low plugging force are achieved at the same time when the plug connection is inserted.

According to one embodiment of the invention, the two plug connectors are in the form of multiple connector strips in which the individual connections are arranged, in particular, in a plurality of parallel rows.

Another embodiment of the invention is distinguished in that the second plug connector is designed for direct connection to a circuit board. In particular, the second plug connector can be mounted on the circuit board using SMD mounting technology.

A further embodiment of the invention is distinguished in that the first coaxial contact arrangements to be mounted in a floating manner in the first plug connector are inserted transverse to the plug axis so as to latch into a bearing plate, and in that the bearing plate is held with radial play in the first housing. In particular, the bearing plate is in the form of a comb with outwardly projecting teeth, with accommodation spaces for accommodating the inserted first coaxial contact arrangements being arranged between said teeth. Depending on requirements, the comb can be fitted with the maximum number of contact arrangements, but also with a lower number of contact arrangements, and therefore a system which can be used in a flexible manner is provided.

A preferred development of this embodiment is characterized in that the first coaxial contact arrangements have a cylindrical shape, and in that the accommodation spaces in each case comprise a round accommodation section, of which the diameter is matched to the first coaxial contact arrangement, and a straight insertion section which connects the accommodation section to the exterior and has a width which is slightly smaller than the diameter of the accommodation section, in such a way that the first coaxial contact arrangement can be inserted through the insertion section so as to latch into the accommodation section. Mounting of the plug connector is considerably simplified as a result.

In this case, positioning of the first coaxial contact arrangement can be simplified by the first coaxial contact arrangement having a peripheral latching groove, of which the outside diameter is matched to the diameter of the accommodation section.

The first housing preferably has an interior which proceeds in the direction of the plug axis and is open at the ends, with the bearing plate or the comb being held with play in recesses in the first housing which are intended for this purpose.

According to another embodiment of the invention, the first contact arrangements are permanently connected, in particular soldered, to the associated coaxial cable.

It is also advantageous if the bearing plate or the comb is composed of a plastic.

A further embodiment of the invention is characterized in that the first coaxial contact arrangement is in the form of a socket and has a contact sleeve, which acts as an external conductor, with an insertion opening for inserting the second coaxial contact arrangement, in which insertion opening a first internal conductor is arranged in a concentric manner and is held in the contact sleeve by means of a first insulating piece, said internal conductor merging with a contact socket in the direction of the insertion opening.

A preferred development of this embodiment is distinguished in that the second coaxial contact arrangement is in the form of a plug and has an annular base in which a second internal conductor is arranged in a concentric manner and is held in the base by means of a second insulating piece, said second conductor merging with a contact pin at the front, and in that a crown of sprung contact arms which extend in the axial direction is integrally formed on the base, said crown moving into the contact sleeve of the associated first coaxial contact arrangement and making contact with the inside of said contact sleeve when the plug connection is inserted. It is also advantageous if the second housing is composed of a metal or a metallized plastic and has a number of holes of graduated diameter which corresponds to the number of second coaxial contact arrangements, and if the second coaxial contact arrangements are pressed, by way of their base, into the holes so as to be fixedly seated.

In order to assist the alignment of the first contact arrangements with the second contact arrangements, particularly in the case of rigid coaxial cables, a cable guide can be provided according to another embodiment of the invention to guide the coaxial cables departing from the first contact arrangements.

In particular, the cable guide can be in the form of a separate, integral body which has a number of passage holes for conducting the coaxial cables which corresponds to the maximum number of coaxial cables, with the cable guide being composed of a plastic, and being attached to the first housing in an interlocking or cohesive manner. Latching means which are matched to one another are preferably provided on the cable guide and on the first housing for attaching the cable guide to the first housing.

The method according to the invention is distinguished in that, in a first step, the coaxial cables which are provided for the multiple coaxial cable plug connection are cut to length and the first coaxial contact arrangements are in each case attached, in particular soldered or crimp-connected, to the ends of the coaxial cables so as to make contact, in that, in a second step, the coaxial cables manufactured in this way are inserted into the bearing plate or the comb in a latching manner by way of the first coaxial contact arrangements, and in that, in a third step, the bearing plate or the comb, with the manufactured coaxial cables held therein, is inserted into the first housing and fixed there.

If, in particular, a first housing comprising metal is used, after being inserted into the first housing, the bearing plate or the comb are calked there.

If a first housing comprising plastic is used, the bearing plate or the comb can be inserted so as to latch into the first housing in the third step.

One embodiment of the method according to the invention is characterized in that, in a fourth step, the coaxial cables are guided through a cable guide which is attached to the first housing.

BRIEF DESCRIPTION OF THE DRAWINGS

The invention will be explained in greater detail below with reference to exemplary embodiments in conjunction with the drawing, in which

FIG. 11 shows a perspective illustration of the first coaxial contact arrangement from the upper plug connector from FIGS. 1 and 2;

FIG. 12 shows a longitudinal section through the lower plug connector from FIGS. 1 and 2;

FIG. 13 shows a plan view, from above, of the lower plug connector from FIGS. 1 and 2;

FIG. 14 shows an enlarged detail of the second contact arrangement from the contact connector of FIG. 12;

DESCRIPTION OF PREFERRED EMBODIMENTS

Figure 1:
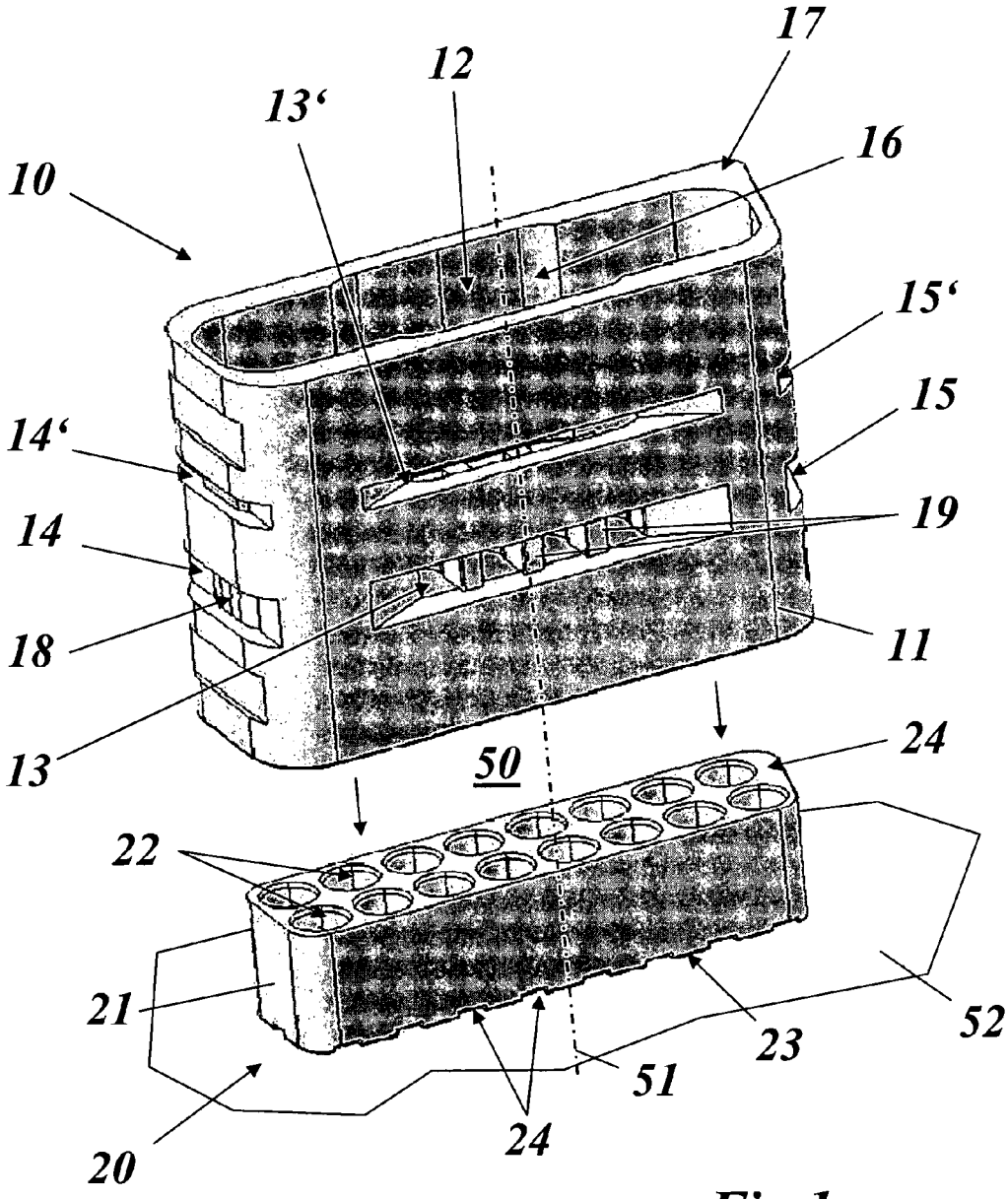
FIG. 1 shows a perspective view of the basic elements of a plug connection with 16 individual connections according to one exemplary embodiment of the invention.
Figure 2:
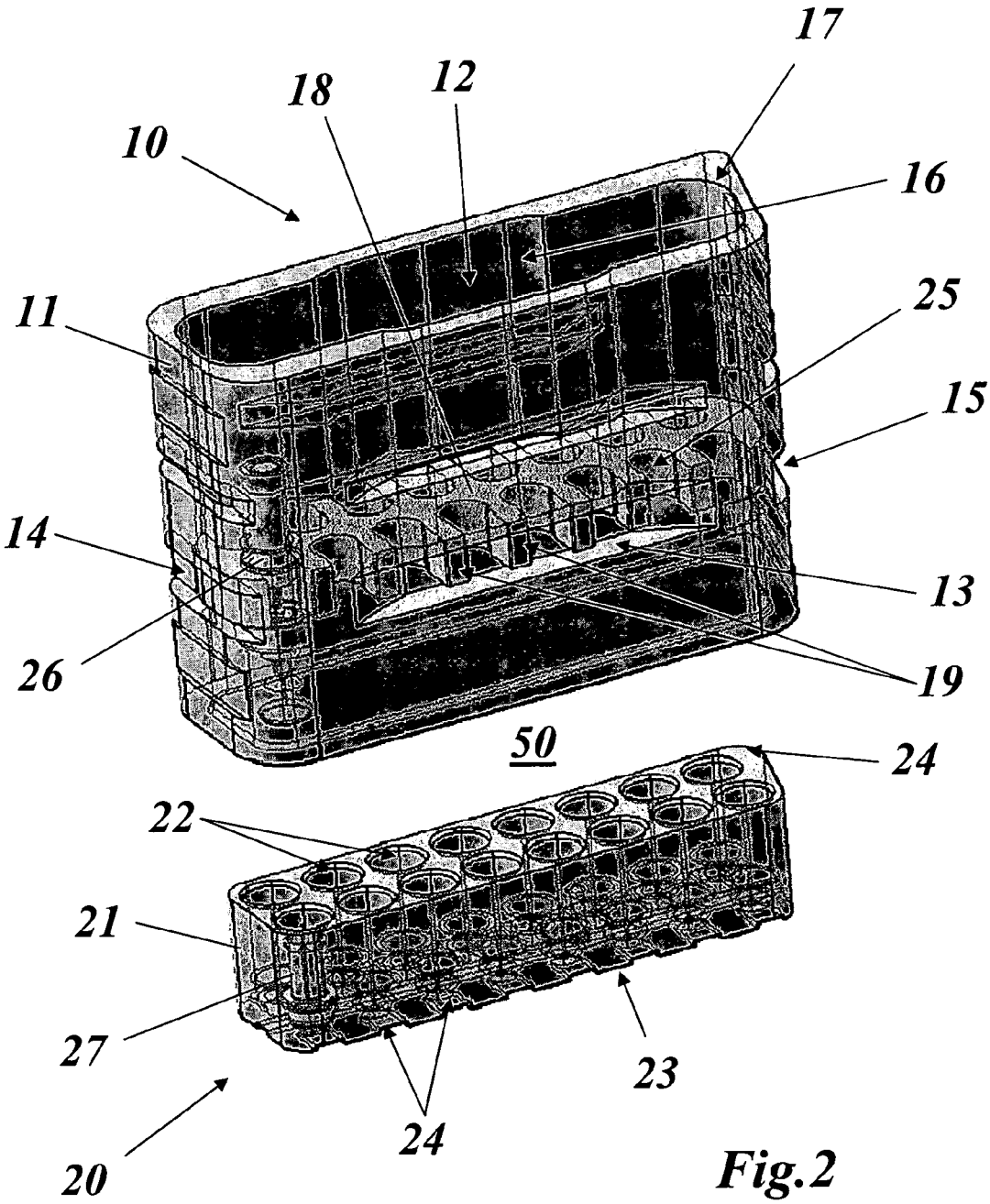
FIG. 2 shows, in an illustration which is comparable to FIG. 1 and in which the housing of the plug connectors are at least partially transparent, the internal design of the plug connection according to the exemplary embodiment.
Figure 3:
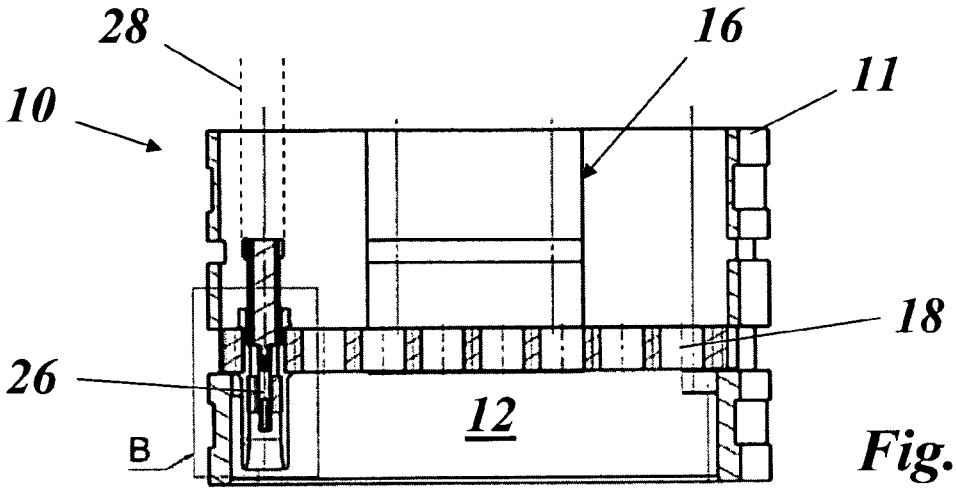
FIG. 3 shows a longitudinal section through the upper plug connector from FIGS. 1 and 2.

FIGS. 1 and 2 show the basic elements of a multiple coaxial cable plug connection 50 according to one exemplary embodiment of the invention for the connection of a plurality of coaxial cables to a circuit board 52 (PCB, multilayer board etc., not illustrated further). The multiple coaxial cable plug connection 50 comprises a multiple connector strip 20 which is mounted on and connected to the circuit board 52 by means of SMD mounting technology, and a multiple connector strip 10 which is inserted into the multiple connector strip 20 along a plug axis 51 (arrows in FIG. 1) in the manner of a plug.

The multiple connector strip 20, of which the configuration and the internal design are also illustrated in FIGS. 12 to 16, comprises a housing 21 which is in the form of a metal block and in which, in the present exemplary embodiment, 2 parallel rows of in each case eight axial holes 22 of graduated diameter are made. The holes 22 in the two rows are at a standardized distance from one another (in the present example 4 mm), which corresponds to the distance between the corresponding plug inserts (26) in the multiple connector strip 10. Each of the 16 holes 22 can produce a coaxial cable connection, and therefore the multiple coaxial cable plug connection 50 of the exemplary embodiment permits the simultaneous plug-connection of a total of a maximum of 16 coaxial cables.

Figure 16:
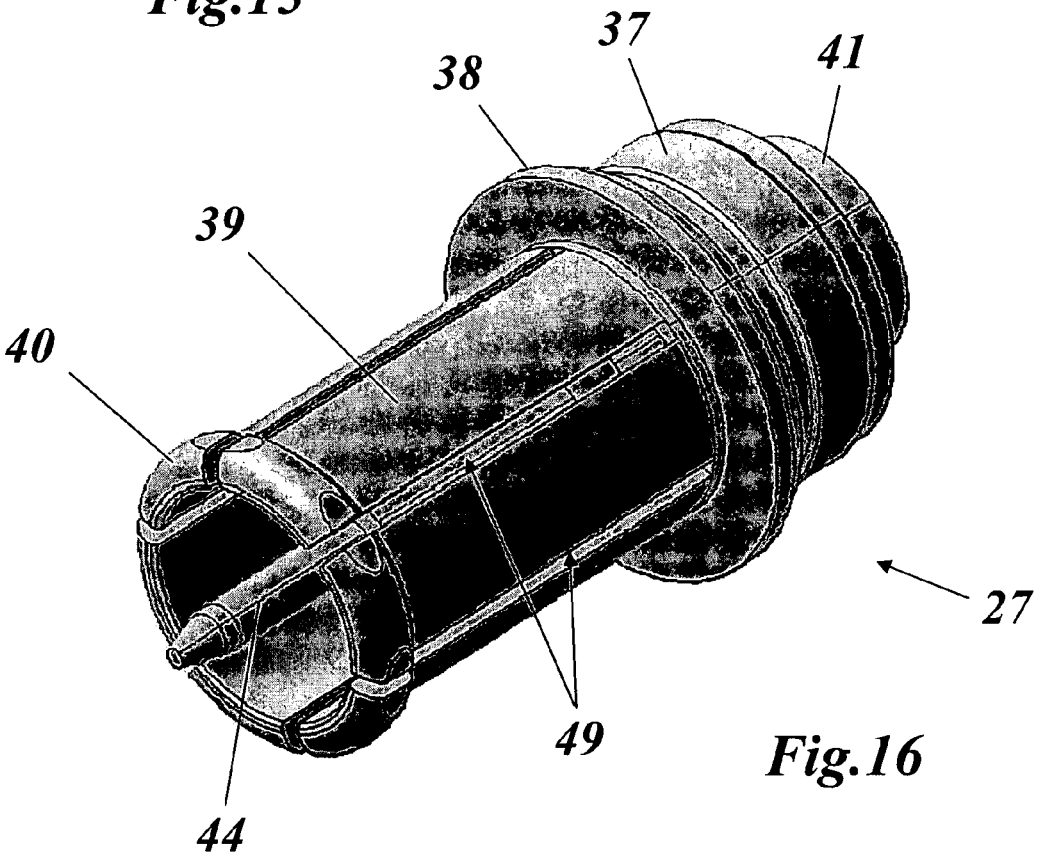
FIG. 16 shows a perspective illustration of the second coaxial contact arrangement from the lower plug connector from FIGS. 1 and 2.
Figure 17:
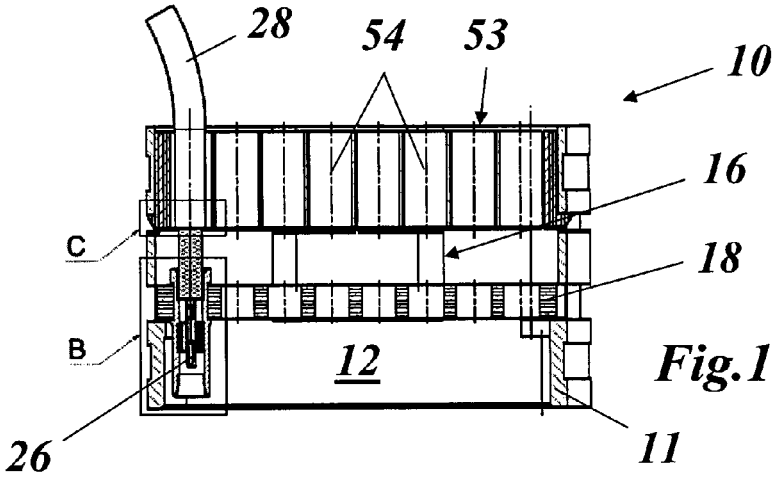
FIG. 17 shows, in an illustration which is comparable to FIG. 3, the upper plug connector from FIG. 3 with a cable guide, which is additionally latched into the first housing, as an alignment and kink-prevention element.
Figure 18:
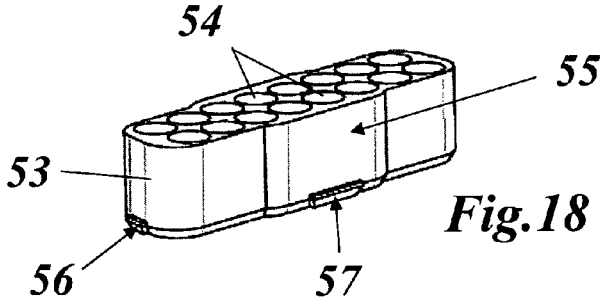
FIG. 18 shows a perspective illustration of the cable guide from FIG. 17.
Figure 19:
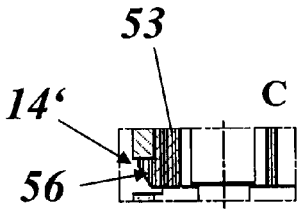
FIG. 19 shows two enlarged details (B and C) from FIG. 17.
Figure 19:
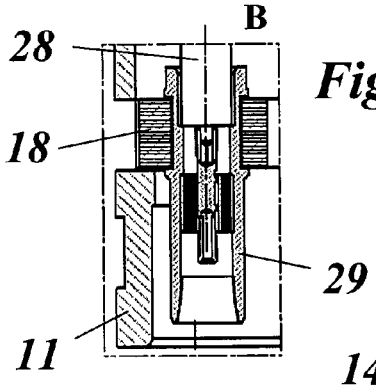
Figure 20:
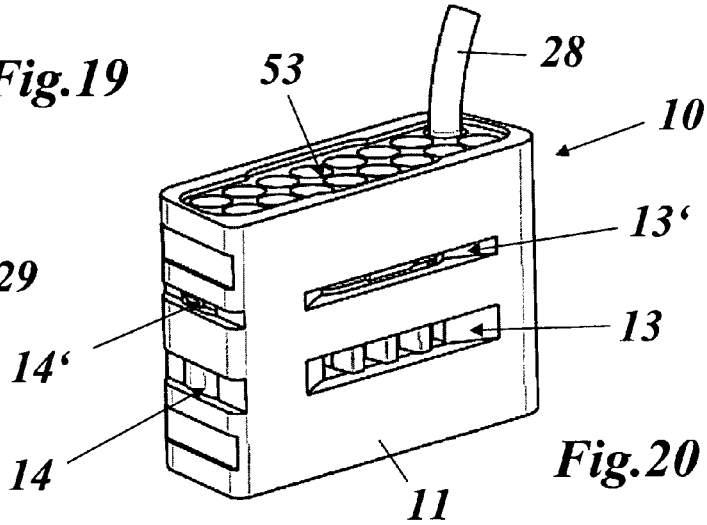
FIG. 20 shows a perspective illustration of the plug connector, with the cable guide, from FIG. 17.

As can be seen in FIGS. 2, 12 and 14, in each case one contact arrangement 27 is inserted (pressed) into the holes 2, said contact arrangements being illustrated individually in FIG. 16 and the design of said contact arrangements being shown in FIG. 14. The contact arrangement 27 has an annular base 37 with a stop 38. Said contact arrangement is pressed into the hole 22 by way of the base 37 so as to form an annular gap 45.

An internal conductor 42 is arranged in an axial hole in the base in a concentric manner, said internal conductor being centered and held in the base 37 by means of an insulating piece 41. The internal conductor 42 terminates flush with the mounting face 23 of the housing 21 in the direction of the circuit board 52 (FIGS. 2, 14) and is accessible from below through the opening 46 (FIG. 15), while the insulating piece 41 is recessed. On the insertion side, the internal conductor 42 has, for the purpose of impedance matching, a central piece 43 of enlarged diameter, and then merges with a tapered contact pin 44. The central piece 43 and the contact pin 44 are concentrically surrounded by a crown of axially oriented contact arms 39 which are separated from one another by slots 49, start from the base 38 and can be radially deflected by way of their free ends. Contact beads 40 are arranged on the outside at the free ends of the contact arms 39, said contact beads being used to establish, upon insertion, electrical contact between the contact arms 39 and the inner wall of the contact sleeve 29 (FIG. 5) of the associated contact arrangement 26 in the mating piece (multiple connector strip 10).

Figure 7:
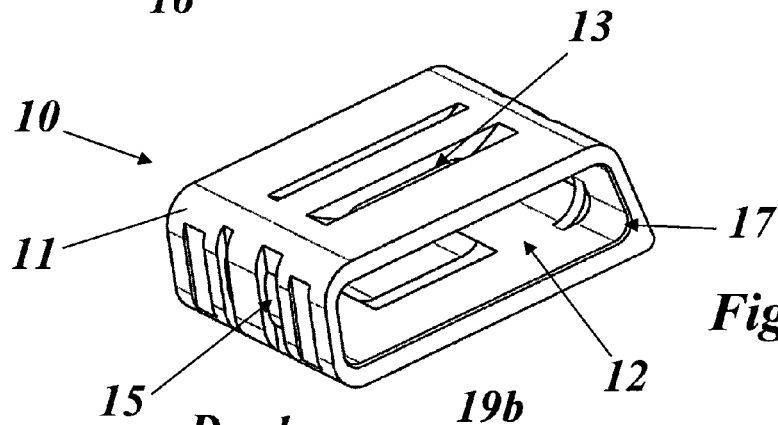
FIG. 7 shows a second perspective view of the housing of the upper plug connector from FIGS. 1 and 2.
Figure 15:
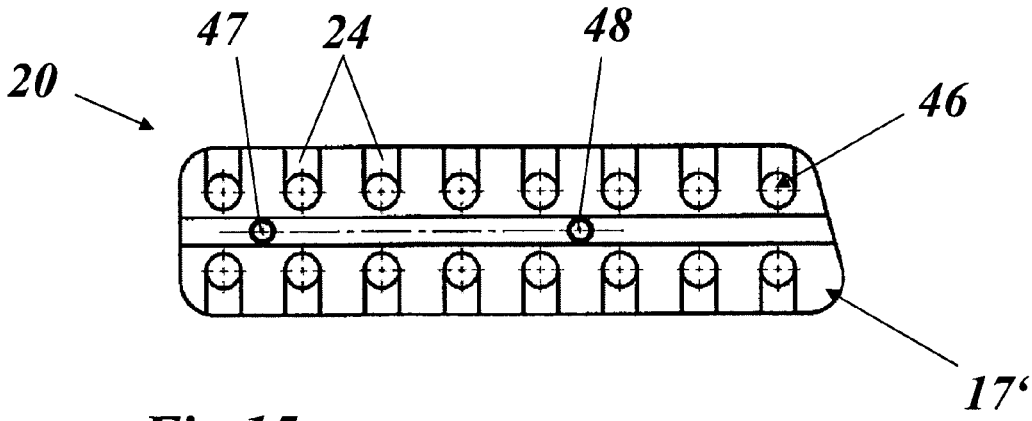
FIG. 15 shows the plan view from below of the lower plug connector from FIGS. 1 and 2.

The metal housing 21 of the multiple connector strip 20 forms a common external conductor for all the individual plug connections. In addition, said metal housing has an asymmetrical cross-sectional contour with a coding 17' in the form of a corner which projects obliquely outward and corresponds to a coding 17 on the housing 11 (FIG. 7) of the multiple connector strip 10 and ensures that the two plug connectors can be plug-connected to one another only in a predetermined manner. Milled-out portions 24 which lead outward from the holes 22 are provided in the mounting face 23 of the housing 21 (FIG. 15), said milled-out portions enabling the internal conductor 42 to be guided to the outside in a manner insulated from the housing 21 on the upper face of the circuit board 52. In order to position the housing 21 on the circuit board 52, asymmetrically arranged guide holes 47 and 48 are arranged in the housing 21 between the two rows of holes 22 (FIG. 15).

Figure 5:
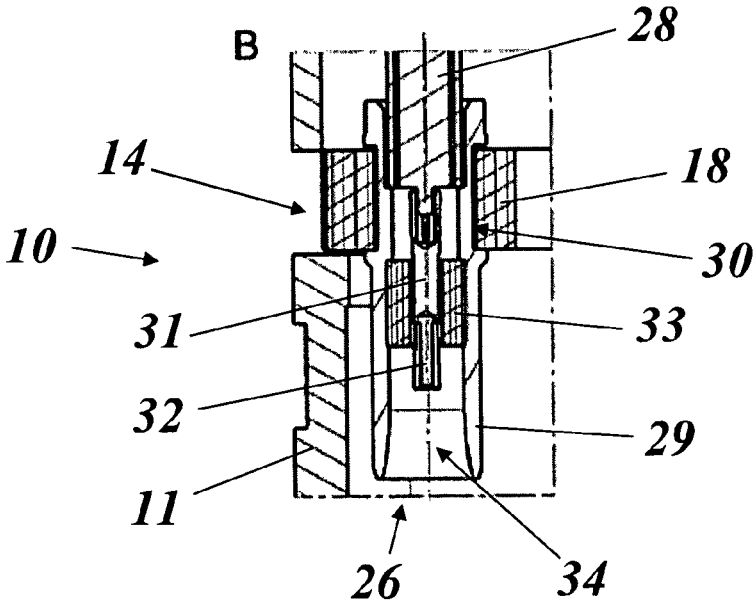
FIG. 5 shows the enlarged detail (B) from FIG. 3.
Figure 6:
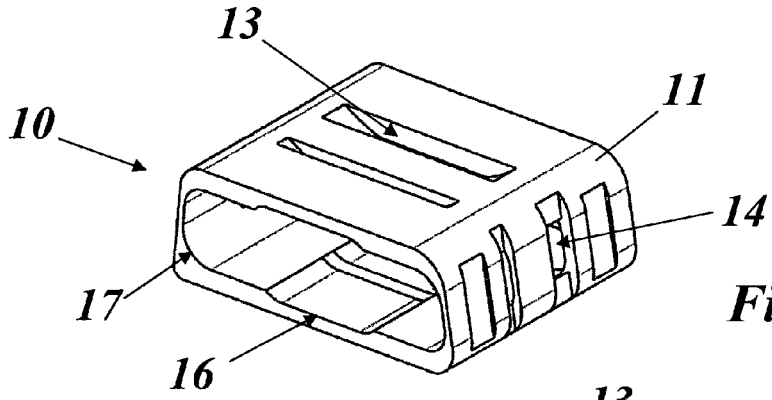
FIG. 6 shows a first perspective view of the housing of the upper plug connector from FIGS. 1 and 2.

As already mentioned, each contact arrangement 27 in the multiple connector strip 20 has an associated corresponding contact arrangement 26 in the multiple connector strip 10. The contact arrangement 26, of which the design is shown in FIG. 5, comprises a contact sleeve 29 which acts as an external conductor and in which an internal conductor 31 is centered and held by means of an insulating piece 33 in a concentric manner. The internal conductor 31 merges with a contact socket 32 in the direction of the plugging side, said contact socket accommodating the contact pin 44 of the contact arrangement 27 upon insertion. At the other end, the internal conductor 31 accommodates the internal conductor of a coaxial cable 28, the contact arrangement 26 being soldered to the end of said coaxial cable. The external conductor of the coaxial cable 28 is connected to the rear end of the contact sleeve 29 in this case. The contact sleeve 29 is conically widened on the inside in the direction of the plugging side, in order to facilitate insertion of the contact arms 39 of the contact arrangement 27. The electrically conductive contact parts of the two contact arrangements 26, 27 are preferably composed of CuBe and are surface-treated, in particular gold-plated.

Figure 8:
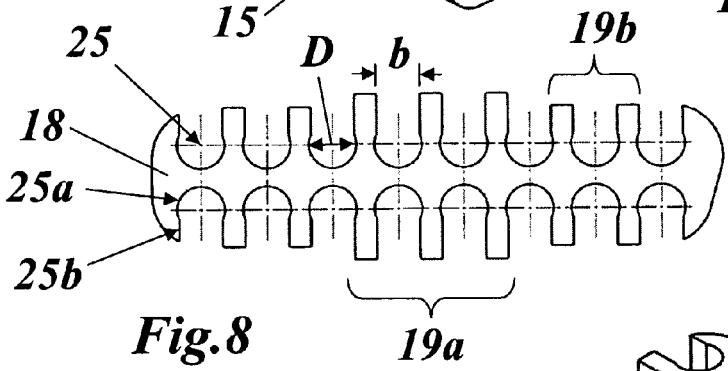
FIGS. 8-10 show various views of the comb which is inserted into the upper plug connector from FIGS. 1 and 2.
Figure 9:
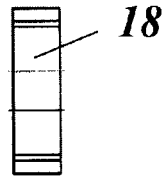
Figure 10:
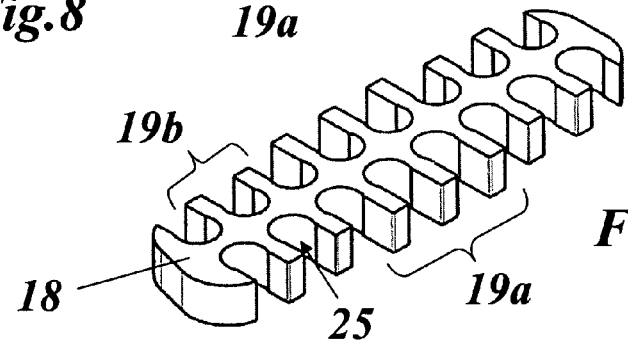

In order to facilitate alignment of the contact arrangements 26, 27 in pairs when the multiple connector strip 10 is inserted into the multiple connector strip 20, and therefore to achieve a high degree of precision in the plugged connection together with a reduced plugging force, this allowing operating frequencies of up to 40 GHz, the coaxial cables 28 are mounted in a floating manner in the housing 11 of the multiple connector strip 10 by way of the contact arrangements 26 which are soldered to the ends. To this end, a mounting plate, which is in the form of a comb 18, is used, said mounting plate being separately illustrated in FIGS. 8-10. The external design of the comb 18, which is preferably composed of a suitable plastic, is matched to the cross-sectional contour of the housing 11. On the outer periphery, said comb has a plurality of outwardly projecting teeth 19, 19*a, b*, accommodation spaces 25 for the contact arrangements 26 being left free between said teeth. Each of the accommodation spaces 25 in each case comprises a round accommodation section 25*a*, of which the diameter is matched to the first coaxial contact arrangement 26, and a straight insertion section 25*b* which connects the accommodation section 25*a* to the exterior. The round accommodation sections 25*a* correspond, in terms of their lateral arrangement, to the holes 22 in the housing 21 of the other multiple connector strip 20. The insertion section 25*b* has a width b (FIG. 8) which is smaller than the diameter D of the accommodation section 25*a*, specifically in such a way that the first coaxial contact arrangement 26 can be inserted laterally through the insertion section 25*b* so as to latch into the accommodation section 25*a*. The contact arrangement 26 which is held in the comb 18 is fixed in the axial direction by a peripheral latching groove 30 being formed on the contact sleeve 29 (FIG. 11), the width of said latching groove corresponding to the thickness of the comb 18.

Figure 4:
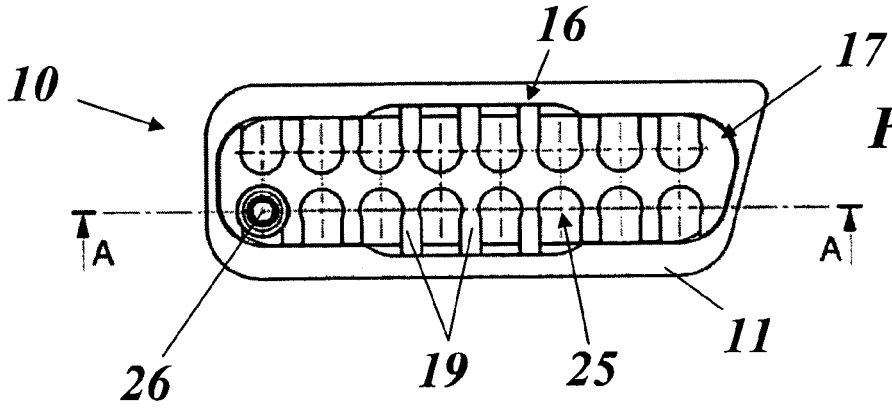
FIG. 4 shows a plan view, from above, of the upper plug connector from FIGS. 1 and 2.

If all 16 coaxial cables 28 are snapped into the respective accommodation sections 25*a* by way of their soldered contact arrangements 26 in the comb 18, the comb 18 which is equipped in this way is inserted into the interior 12 of the housing 10 from the rear and is held there in a floating manner. This process differs depending on whether the housing 11 is produced from metal or from a yielding plastic. In the illustrated exemplary embodiment, it is assumed that the housing 11 is composed of metal. In each case two parallel slots 13, 13' and 14, 14' and 15, 15' are provided in the wall of the housing 11 on all four sides. The lower, wider slots 13, 14 and 15 (slot width=comb thickness) accommodate the comb 18 and hold said comb with radial play. The upper, narrower slots 13', 14 and 15' each define a web which is situated between the pairs of slots and can be used to calk the comb 18 in the housing 11: the central teeth 19*a* of the comb 18 are longer than the other teeth 19*b*. In accordance with the longer teeth 19*a*, a recess 16 which is matched to the longer teeth 19*a* is made in the housing 11 on each of the opposite walls, said recess running forward from the rear and ending in the region of the slots 13. When the comb 18 is inserted into the housing 11, the longer teeth 19*a* can move forward into the recesses 16 without obstruction (FIG. 4) until they butt against the end of the recess 16 level with the slots 13. The webs between the slots 13, 13' and 14, 14' and 15, 15' can then be calked on the inside in order to hold the comb in this position.

If the housing 11 is composed of a plastic, the webs can be used as latching means which are deflected elastically outward when the comb 18 is inserted and snap back behind the comb 18 in a latching manner. However, other latching systems are also feasible.

If, upon insertion, the housing 11 of the first multiple connector strip 10 is pushed over the housing 21 of the second multiple connector strip 20, the contact arrangements 26 which are held in the comb 18 with the connected coaxial cables 28 can be matched to the opposite contact arrangements 27 on account of the play, and therefore very precise coaxial connections are produced.

Given comparatively rigid coaxial cables 28, considerable laterally acting forces can act on the first contact arrangements 26 which are fitted to the ends and are snapped into the comb 18, said forces causing the first contact arrangements to tilt and making the plugging operation more difficult. In order to reliably avoid such difficulties, a cable guide 53 can be inserted according to FIGS. 17 to 20, said cable guide aligning the coaxial cables 28 emerging from the first housing 11 in parallel and at the same time preventing kinks.

The cable guide 53 is designed as an integral plastic body (FIG. 18) and has a number of parallel passage holes 54 for conducting the coaxial cables 28 which correspond, in terms of number and arrangement, to the holes 22 in the multiple connector strip 20. The diameter of the passage holes 54 can be selected such that the finished coaxial cables 28 with the first contact arrangement 26 can be pushed through, before they are then snapped into the comb 18.

The edge contour of the cable guide 53 corresponds to the edge contour of the interior 12 of the first housing 11. In particular, a thickened portion 55 is provided on the long sides of the cable guide 53, said thickened portion being matched to the recess 19 in the inner wall of the first housing 11 and serving to guide the cable guide 53 in the housing 11. At the lower edge of the cable guide 53, laterally projecting latching lugs 56, 57 are arranged on each of the four sides, said latching lugs latching into the upper slots 13', 14', 15' when the cable guide 53 is inserted into the first housing 11. In the exemplary embodiment shown, the inserted cable guide 53 terminates virtually flush with the upper edge of the first housing. However, it is also feasible for the cable guide to project to a greater or lesser extent out of the housing 11 toward the rear in order to further increase the support and alignment of the coaxial cables. It is also feasible for the cable guide to be formed by injection-molding using a plastic compound and/or to be attached to the first housing in a cohesive manner.

Overall, the invention provides a multiple coaxial cable plug connection which is distinguished by the following properties and advantages:

- multiple cable connection for making contact on a printed circuit, in an extremely narrow space for a high data transmission rate (40 GHz, 40 Gb/s) and a large number of plugging cycles (>3000);
- good shielding properties, low plugging force;
- cable assemblies, which are mounted in a floating manner, in multiple connector strips and a multiple connector strip with SMD mounting technology on the printed board as the mating piece;
- the cable plugs are guided in a comb. The comb is mounted in the multiple connector strip with radial play and allows tolerance compensation in relation to the socket arrangement on the printed board;
- the comb, together with the inserted cable assemblies, is snapped (plastic housing) into or calked (metal housing) in the housing of the connector strip;
- can be used primarily in measurement technology: for precise and efficient testing of printed circuit arrangements; or
- for several cables for printed connections of all types.

The invention claimed is:

1. A multiple coaxial cable plug connection (50), for the detachable connection of a plurality of coaxial cables to a circuit board (52) for operating frequencies of several GHz, the multiple coaxial cable plug connection (50) comprising:

a first plug connector (10) and a second plug connector (20) insertable one into the other along a plug axis (51), the first plug connector (10) having a plurality of first coaxial contact arrangements (26) which are arranged next to one another transverse to the plug axis (51), and the second plug connector (20) being equipped with second coaxial contact arrangements (27) which match the first coaxial contact arrangements (26), and with the first coaxial contact arrangements (26) in each case being attached to the end of an associated coaxial cable (28), wherein the first coaxial contact arrangements (26) are mounted in a floating manner in a first housing (11), while the second coaxial contact arrangements (27) are fixedly installed in a second housing (21), wherein the first coaxial contact arrangements (26) mounted in a floating manner in the first plug connector (10) are inserted transverse to the plug axis (51) to latch into a bearing plate (18), and the bearing plate (18) is held with radial play in the first housing (11), wherein the bearing plate comprises a comb (18) with outwardly projecting teeth (19; 19a,b), with accommodation spaces (25) for accommodating the inserted first coaxial contact arrangements (26) being arranged between said teeth, and wherein the comb (18) is composed of a plastic; and a cable guide (53) being inserted into the first housing to guide the coaxial cables (28) departing from the first contact arrangements (26), wherein the cable guide (53) comprises a separate, integral body including a number of passage holes (54) for conducting the coaxial cables (28) which corresponds to the maximum number of coaxial cables (28), wherein the cable guide (53) comprises latching lugs to be latched into slots of the first housing and is attached into the first housing (11) in an interlocking manner.

2. The multiple coaxial cable plug connection as claimed in claim 1, wherein the two plug connectors (10, 20) form multiple connector strips.

3. The multiple coaxial cable plug connection as claimed in claim 1, wherein the second plug connector (20) directly connects to a circuit board (52).

4. The multiple coaxial cable plug connection as claimed in claim 1, wherein the first coaxial contact arrangements (26) have a cylindrical shape, and the accommodation spaces (25) comprise a round accommodation section (25*a*), of which the diameter is generally matched to the first coaxial contact arrangement (26), and a straight insertion section (25*b*) which connects the accommodation section (25*a*) to the exterior and includes a width (b) slightly smaller than the diameter (D) of the accommodation section (25*a*), the first coaxial contact arrangement (26) insertable through the insertion section (25*b*) to latch into the accommodation section (25*a*).

5. The multiple coaxial cable plug connection as claimed in claim 4, wherein the first coaxial contact arrangement (26) includes a peripheral latching groove (30) having an outside diameter matched to the diameter (D) of the accommodation section (25*a*).

6. The multiple coaxial cable plug connection as claimed in claim 1, wherein the first housing (11) includes an interior (12) which proceeds in the direction of the plug axis (51) and is open at the ends, wherein the comb (18) is held with play in recesses (13, 14, 15) in the first housing (11).

7. The multiple coaxial cable plug connection as claimed in claim 1, wherein the first contact arrangements (26) are at least one of permanently connected, soldered and crimp-connected, to the associated coaxial cable (28).

8. The multiple coaxial cable plug connection as claimed in claim 1, wherein the first coaxial contact arrangement (26) comprises a socket and includes a contact sleeve (29), which acts as an external conductor, with an insertion opening (34) for inserting the second coaxial contact arrangement (27), in which insertion opening a first internal conductor (31) is arranged in a concentric manner and is held in the contact sleeve (29) by a first insulating piece (33), said internal conductor merging with a contact socket (32) in the direction of the insertion opening (34).

9. The multiple coaxial cable plug connection as claimed in claim 8, wherein the second coaxial contact arrangement (27) comprises a plug and includes an annular base (37) in which a second internal conductor (31) is arranged in a concentric manner and is held in the base (37) by a second insulating piece (41), said second conductor merging with a contact pin (44) at a front, and a crown of sprung contact arms (39) which extend in the axial direction is integrally formed on the base (37), said crown moving into the contact sleeve (29) of the associated first coaxial contact arrangement (26) and making contact with the inside of said contact sleeve when the plug connection is inserted.

10. The multiple coaxial cable plug connection as claimed in claim 9, wherein the second housing (21) is composed of a metal or a metallized plastic and includes a number of holes (22) of graduated diameter which c correspond with to the number of second coaxial contact arrangements (27), and the second coaxial contact arrangements (27) are pressed, by way of their base (37), into the holes (22) so as to be fixedly seated.

11. A multiple coaxial cable plug connection (50), for the detachable connection of a plurality of coaxial cables to a circuit board (52) for operating frequencies of several GHz, the multiple coaxial cable plug connection (50) comprising:

a first plug connector (10) and a second plug connector (20) insertable one into the other along a plug axis (51), the first plug connector (10) having a plurality of first coaxial contact arrangements (26) which are arranged next to one another transverse to the plug axis (51), and the second plug connector (20) being equipped with second coaxial contact arrangements (27) which match the first coaxial contact arrangements (26), and with the first coaxial contact arrangements (26) in each case being attached to the end of an associated coaxial cable (28), wherein the first coaxial contact arrangements (26) are mounted in a floating manner in a first housing (11), while the second coaxial contact arrangements (27) are fixedly installed in a second housing (21), wherein the first coaxial contact arrangements (26) mounted in a floating manner in the first plug connector (10) are inserted transverse to the plug axis (51) to latch into a bearing plate (18), and the bearing plate (18) is held with radial play in the first housing (11), wherein the bearing plate comprises a comb (18) with outwardly projecting teeth (19; 19a,b), with accommodation spaces (25) for accommodating the inserted first coaxial contact arrangements (26) being arranged between said teeth, and wherein the comb (18) is composed of a plastic; and a cable guide (53) being inserted into the first housing to guide the coaxial cables (28) departing from the first contact arrangements (26), wherein the cable guide (53) comprises a separate, integral body including a number of passage holes (54) for conducting the coaxial cables (28) which corresponds to the maximum number of coaxial cables (28), wherein the cable guide (53) is attached into the first housing (11) in a cohesive manner.

12. The multiple coaxial cable plug connection as claimed in claim 11, wherein the two plug connectors (10, 20) form multiple connector strips.

13. The multiple coaxial cable plug connection as claimed in claim 11, wherein the second plug connector (20) directly connects to a circuit board (52).

14. The multiple coaxial cable plug connection as claimed in claim 11, wherein the first coaxial contact arrangements (26) have a cylindrical shape, and the accommodation spaces (25) comprise a round accommodation section (25a), of which the diameter is generally matched to the first coaxial contact arrangement (26), and a straight insertion section (25*b*) which connects the accommodation section (25*a*) to the exterior and includes a width (b) slightly smaller than the diameter (D) of the accommodation section (25*a*), the first coaxial contact arrangement (26) insertable through the insertion section (25*b*) to latch into the accommodation section (25*a*).

15. The multiple coaxial cable plug connection as claimed in claim 14, wherein the first coaxial contact arrangement (26) includes a peripheral latching groove (30) having an outside diameter matched to the diameter (D) of the accommodation section (25*a*).

16. The multiple coaxial cable plug connection as claimed in claim 11, wherein the first housing (11) includes an interior (12) which proceeds in the direction of the plug axis (51) and is open at the ends, wherein the comb (18) is held with play in recesses (13, 14, 15) in the first housing (11).

17. The multiple coaxial cable plug connection as claimed in claim 11, wherein the first contact arrangements (26) are at least one of permanently connected, soldered and crimp-connected, to the associated coaxial cable (28).

* * * * *